US008418699B2

(12) United States Patent
Kim

(10) Patent No.: US 8,418,699 B2
(45) Date of Patent: Apr. 16, 2013

(54) HAIR IRON

(75) Inventor: Hae Jin Kim, Seoul-si (KR)

(73) Assignee: GHD Korea, Inc., Chungcheongnam-do (KR)

( * ) Notice: Subject to any disclaimer, the term of this patent is extended or adjusted under 35 U.S.C. 154(b) by 332 days.

(21) Appl. No.: 12/953,991

(22) Filed: Nov. 24, 2010

(65) Prior Publication Data

US 2011/0247647 A1 Oct. 13, 2011

(51) Int. Cl.

| | |
|---|---|
| ***A45D 2/40*** | (2006.01) |
| *E05D 7/12* | (2006.01) |
| *E05D 1/06* | (2006.01) |

(52) U.S. Cl.

USPC ..... 132/224; 16/258; 16/262; 16/268

(58) Field of Classification Search ..... 132/223–227, 132/229, 231–233; 16/258, 262, 268; 219/225; D28/35, 38

See application file for complete search history.

(56) References Cited

U.S. PATENT DOCUMENTS 5,649,309 A * 7/1997 Wilcox et al. ..... 455/575.3
7,369,414 B2 * 5/2008 Kim ..... 361/752

FOREIGN PATENT DOCUMENTS

WO WO 2007078049 * 7/2007

* cited by examiner

*Primary Examiner* — Rachel Steitz
*Assistant Examiner* — Jennifer Gill
(74) *Attorney, Agent, or Firm* — Hoffmann & Baron, LLP

(57) ABSTRACT

Disclosed herein is a hair iron having upper and lower casings, a heat generating unit and a hinge connection unit. The hinge connection unit includes a hinge box secured to either of the upper and lower casings. First and second movable members each having a hinge shaft are provided in the hinge box, and move between a hinge coupling position and a hinge releasing position. An elastic member is elastically provided between the first and second movable members, and exerts an elastic force so that the hinge shaft moves to the hinge releasing position. A hinge-coupling retaining means is manipulated on an outside of the hinge box to move the hinge shaft to the hinge coupling position and simultaneously retain the hinge shaft in the hinge coupling position. A hinge-shaft connection lug is provided on a remaining one of the upper and lower casings, and has a hinge hole.

9 Claims, 8 Drawing Sheets

HAIR IRON

BACKGROUND OF THE INVENTION

1. Field of the Invention

The present invention relates generally to a hair iron which applies heat to hair to create a variety of hairstyles and, more particularly, to a hair iron which is widely used as a tool for setting hair in a general beauty shop or home.

2. Description of the Related Art

Generally, a hair iron is divided into upper and lower casings to allow hair to be inserted between the upper and lower casings. The upper and lower casings are connected at first ends thereof to each other by a hinge structure so that the upper and lower casings rotate at a predetermined angle, thus allowing the upper and lower casings to come into close contact with each other or to move away from each other.

Either or each of the upper and lower casings is provided with a heat generating unit to apply heat to the hair. For example, the heat generating unit may include a hot plate which is in direct contact with hair, a heater which generates heat to supply the heat to the hot plate, and a power supply circuit unit which supplies power to the heater. Thus, when power is applied from the power supply circuit unit to the heater, the heater generates heat and heats the hot plate. Thereby, heat and pressure are applied to hair which is placed between the upper and lower casings, so that a hairstyle can be changed.

Meanwhile, in the hinge structure enabling the upper and lower casings to come into close contact with each other and move away from each other at a predetermined angle, hinge holes formed in the first ends of the upper and lower casings are aligned with each other, and thereafter a hinge shaft is fitted into the hinge holes. Further, an elastic member, including a torsion spring or a plate spring, is installed between the upper and lower casings, so that both ends of the elastic member are supported, respectively, by the upper and lower casings. Thus, when force is exerted on the upper and lower casings to put them in contact with each other, so that both the heat generating units come into contact with each other, the elastic member is elastically compressed. Meanwhile, when the force is removed from the upper and lower casings, the upper and lower casings move away from each other by the elastic restoring force of the elastic member.

However, the conventional hinge structure requires a construction for preventing the hinge shaft from being removed from the hinge holes of the upper and lower casings, after the hinge shaft has been fitted into the hinge holes. For example, a locking screw having a head which is larger than the hinge hole is fastened to each of the opposite ends of the hinge shaft, or a locking ring which has an outer diameter larger than the hinge hole is provided on each end of the hinge shaft.

Thus, when the hinge structure of the upper and lower casings is assembled or disassembled, the locking screw or the locking ring must be fastened to or unfastened from each end of the hinge shaft, so that it is very complicated and takes a long time to perform the assembly or disassembly operation. As for the locking screw, it is fastened in the same direction as the rotating direction of the hinge structure, so that the locking screw gradually becomes loosened by repeated rotations of the upper and lower casings. Meanwhile, as for the locking ring, the undesirable loosening of the locking ring is prevented, but it is more difficult to connect or disconnect the locking ring to or from the hinge shaft.

Further, in order to connect the locking screw or the locking ring to each of the opposite ends of the hinge shaft, the assembly or disassembly operation must be performed at both sides of the upper and lower casings, so that a coupled part is exposed to the outside, and thus the appearance is poor. Therefore, the coupled part is covered with an additional cover member, and the cover member makes the assembly and disassembly operation of the hinge structure more complicated. In addition, a structure for coupling the cover member to the upper and lower casings is required, so that the hinge coupled part of the upper and lower casings becomes more sophisticated, and thus it is difficult to manufacture a mold and cost is increased.

Further, the conventional hair iron is problematic in that there is heat loss resulting from the transfer of heat from the heat generating unit to the upper and lower casings, and besides, heat is not reliably transferred if a gap is formed between the heater and the hot plate of the heat generating unit, so that thermal efficiency is low.

SUMMARY OF THE INVENTION

Accordingly, the present invention has been made keeping in mind the above problems occurring in the prior art, and an object of the present invention is to provide a hair iron, which allows a hinge connection unit of upper and lower casings to be very rapidly and conveniently assembled and disassembled, prevents hinge coupling from being loosened due to the upper and lower casings being repeatedly rotated, and does not require an additional cover member for covering a part which holds opposite ends of a hinge shaft.

Another object of the present invention is to provide a hair iron, which is constructed to increase a support force of an elastic member elastically provided between upper and lower casings and easily control an elastic force, thus improving elasticity when the upper and lower casings are operated to come into close contact with each other or move away from each other, and which has an insulating member between each of the upper and lower casings and a heat generating unit, thus preventing heat from being transferred from the heat generating unit to each of the upper and lower casings, and which allows easy coupling between a heater and a heater casing of the heat generating unit, and puts the heater in close contact with a hot plate, thus improving heat transfer efficiency.

A further object of the present invention is to provide a hair iron, which has an anion generator on either of an upper or lower casing, thus providing anions as nutrient to weakened hair and pore cells, therefore serving to stimulate pore cells and prevent hair loss.

In order to accomplish the above objects, the present invention provides a hair iron hair iron having upper and lower casings separated from each other to allow hair to be fitted between the upper and lower casings; a heat generating unit provided on either or both of the upper and lower casings; and a hinge connection unit connecting first ends of the upper and lower casings with each other via a hinge shaft so that the upper and lower casings rotate at a predetermined angle about the hinge shaft, wherein the hinge connection unit includes a hinge box secured to either of the upper and lower casings, first and second movable members provided in the hinge box and moving between a hinge coupling position where the hinge shaft protrudes out of the hinge box and a hinge releasing position where the hinge shaft is inserted into the hinge box, each of the first and second movable members having the hinge shaft, an elastic member elastically provided between the first and second movable members and exerting an elastic force so that the hinge shaft moves to the hinge releasing position, a hinge-coupling retaining means manipulated on an outside of the hinge box to move the hinge shaft to the hinge coupling position and simultaneously retain the hinge shaft in the hinge coupling position, and a hinge-shaft connection lug provided on a remaining one of the upper and lower casings and having a hinge hole into which the hinge shaft is fitted when the hinge shaft is in the hinge coupling position.

The hinge-coupling retaining means may include a threaded hole formed in a sidewall of the hinge box, and a hinge-coupling retaining member manipulated to be rotated on the outside of the hinge box and having a threaded part fastened to the threaded hole in a threaded manner and a tapered part provided on an end of the threaded part in such a way that a tip of the tapered part is inclined to be sharp and disposed between the first and second movable members.

The hair iron may further include a plate spring elastically provided between the upper and lower casings and exerting an elastic force in a direction in which the upper and lower casings move when the upper and lower casings move away from each other, wherein the plate spring may include a wide bent part, and a narrow elastic contact part which extends from each of opposite ends of the bent part, with an elastic-force control hole being formed in the wide bent part.

Further, an insulating member may be provided on a side opposite to a heat emission surface of the heat generating unit.

Further, the heat generating unit may include a hot plate serving as the heat emission surface, a heater casing coupled with the hot plate, a heater provided between the hot plate and the heater casing and heating the hot plate, and a contact member elastically provided between the heater and the heater casing and making the heater come into close contact with the hot plate.

Either of the upper and lower casings may include an anion generator generating anions, and an anion guide passage guiding the anions from the anion generator to the hair fitted between the upper and lower casings.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
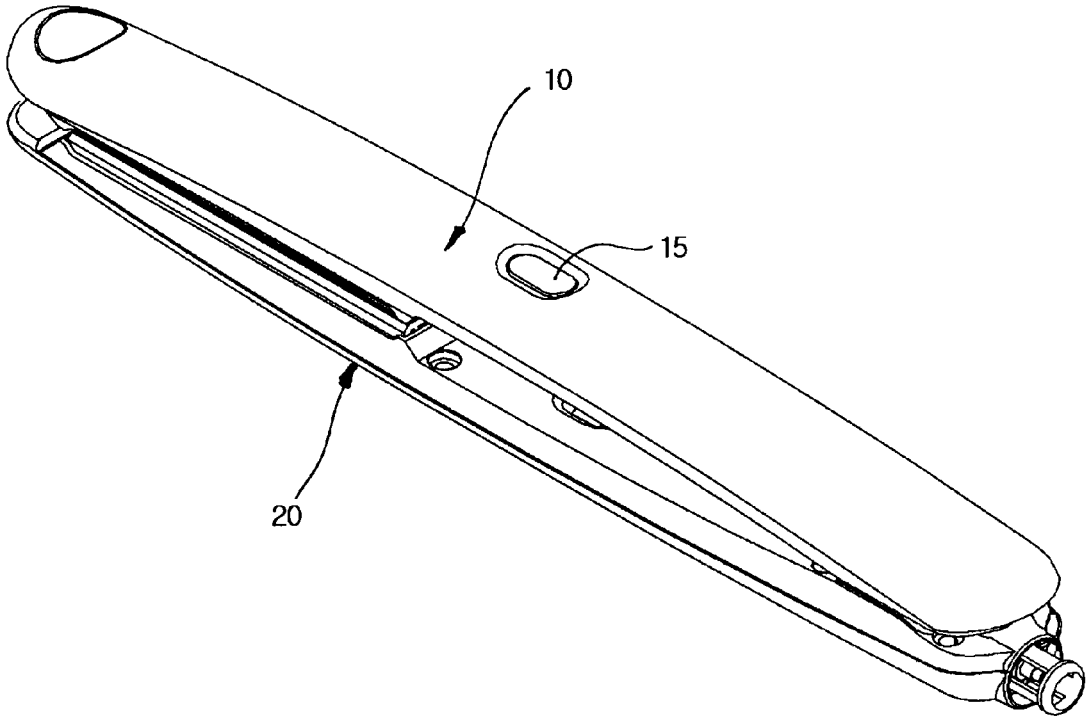
FIG. 1 is a perspective view showing a hair iron according to the present invention.
Figure 2:
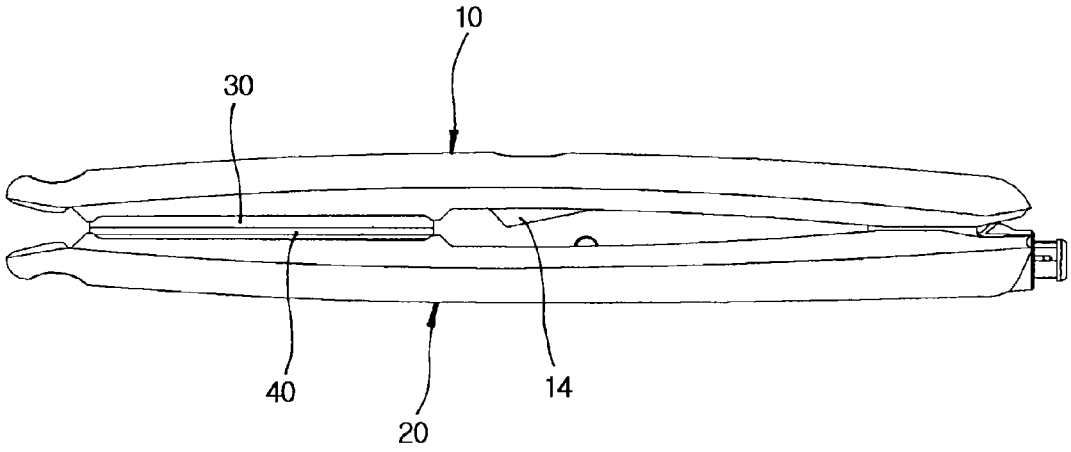
FIG. 2 is a front view showing the hair iron according to the present invention.
Figure 3:
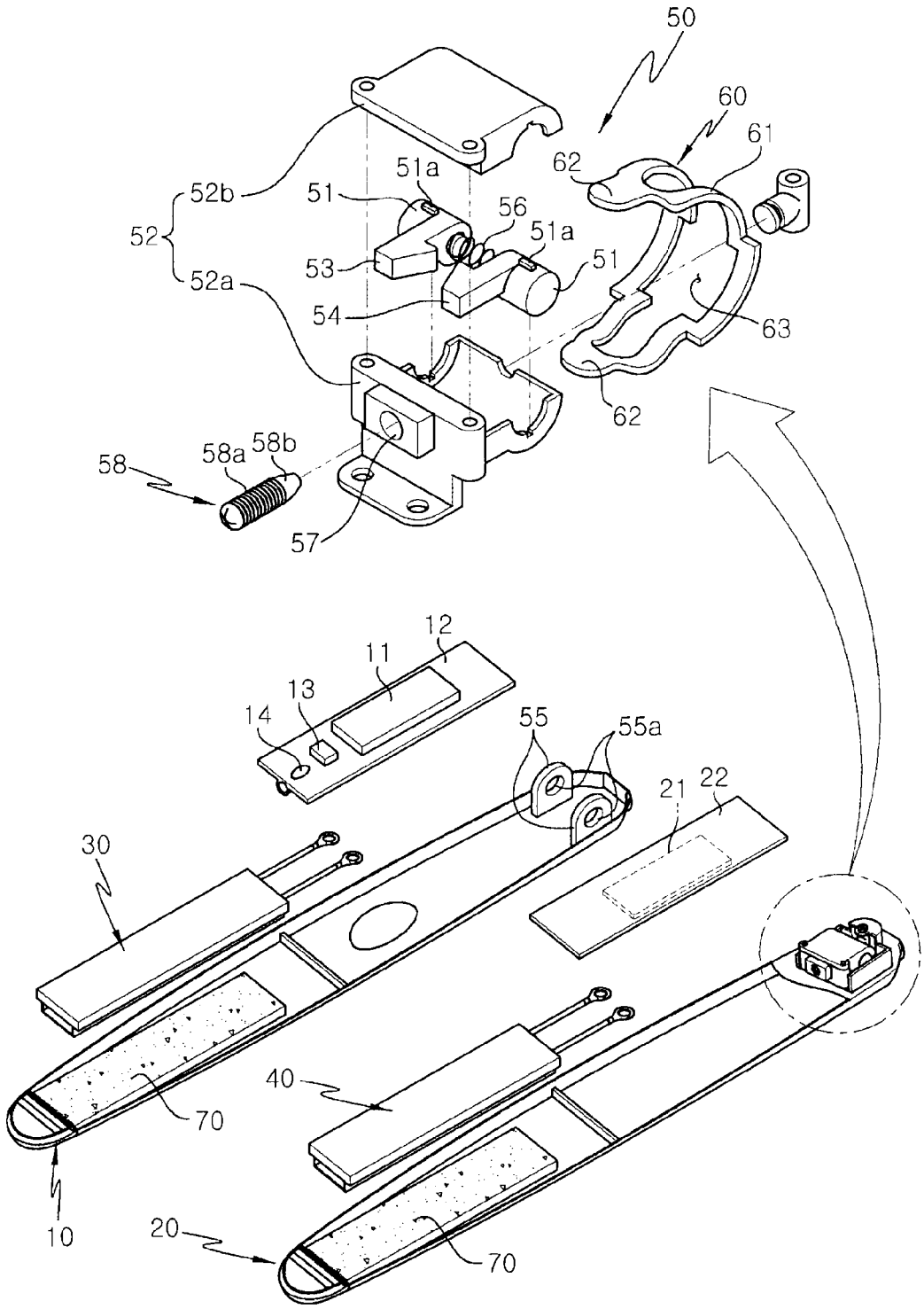
FIG. 3 is an exploded perspective view showing the hair iron according to the present invention.
Figure 4:
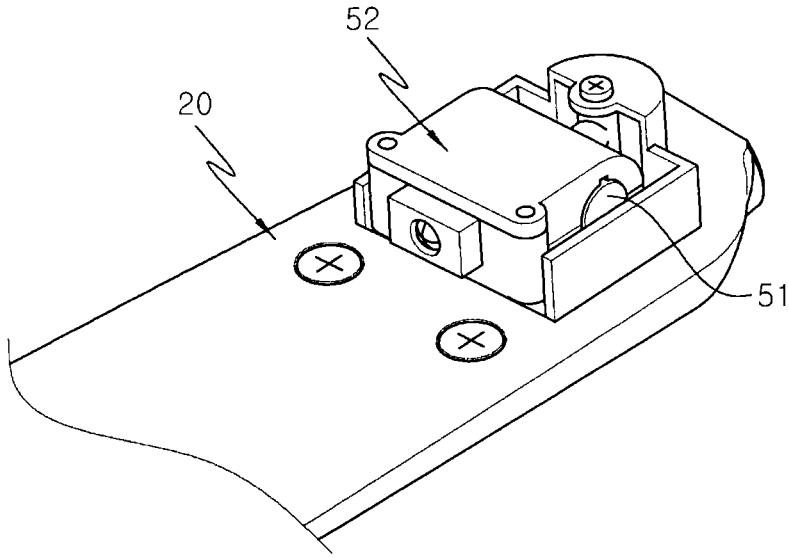
FIG. 4 is a perspective view showing important parts when a hinge box of a hinge connection unit of the hair iron according to the present invention is installed.

Hereinafter, the embodiment of the present invention will be described in detail with reference to the accompanying drawings. FIGS. 1 and 2 are a perspective view and a front view, respectively, showing a hair iron according to the preferred embodiment of the present invention, and FIG. 3 is an exploded perspective view showing the hair iron. The hair iron includes upper and lower casings 10 and 20 which are separated from each other to allow hair to be fitted between them.

Either of the upper and lower casings 10 and 20 is provided with a heat generating unit, or both of the upper and lower casings 10 and 20 are provided with heat generating units. According to this embodiment, the heat generating units 30 and 40 are provided on the upper and lower casings 10 and 20 so that they face each other. Further, the upper and lower casings 10 and 20 are connected at first ends thereof to each other by a hinge connection unit 50 so that the upper and lower casings 10 and 20 may rotate at a predetermined angle about a hinge shaft 51.

The hinge connection unit 50 has a hinge box 52 on either of the upper and lower casings 10 and 20, for example, on the lower casing 20 in the case of this embodiment. The hinge box 52 includes a box body 52*a* and a cover 52*b*, and first and second movable members 53 and 54 each having a hinge shaft 51 are installed in the hinge box 52.

Figure 5A:
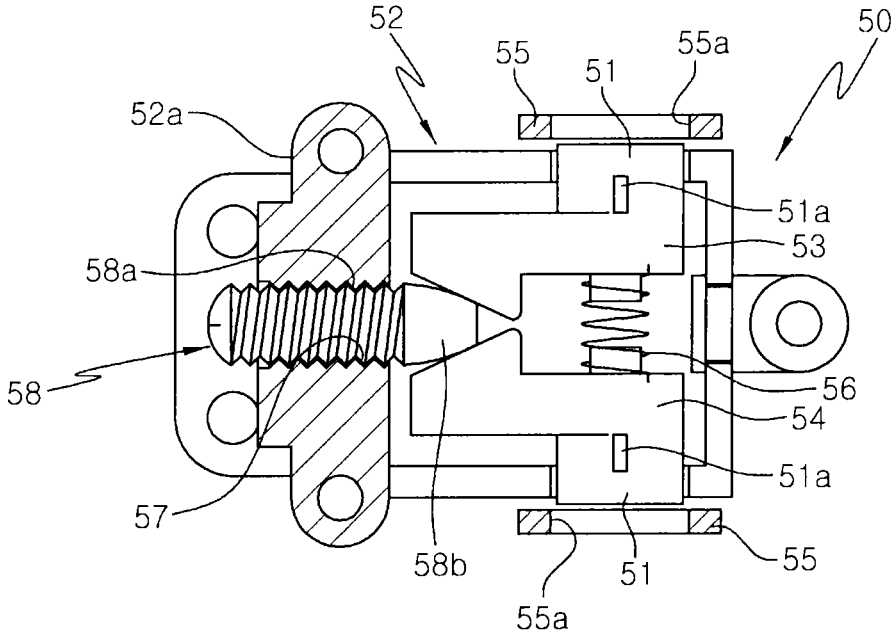
FIGS. 5A and 5B are sectional views showing the hinge connection unit which is in a hinge releasing position and a hinge coupling position in the respective figures.
Figure 5B:
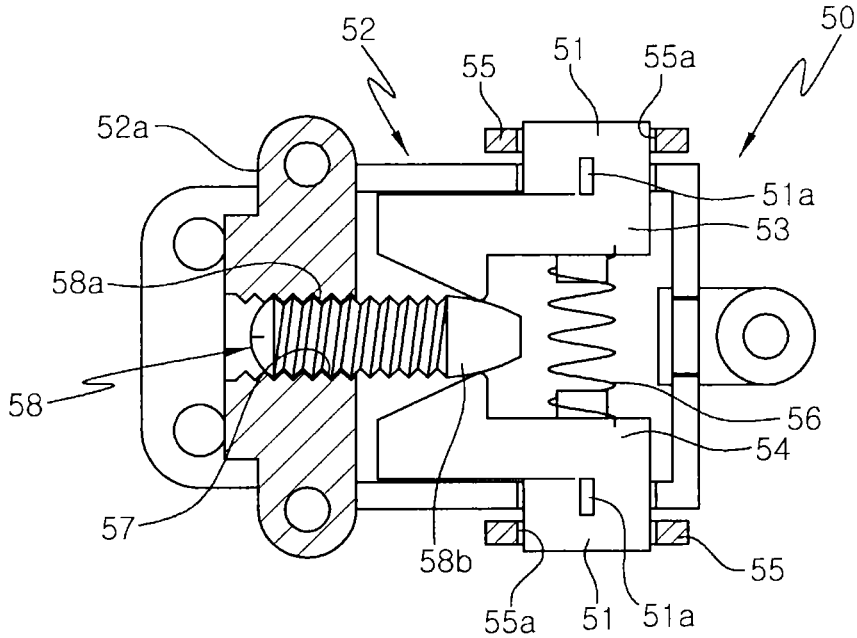

As shown in FIGS. 5A and 5B in detail, the first and second movable members 53 and 54 are installed in such a way that the respective hinge shafts 51 extend to the outside through holes which are formed in both sidewalls of the hinge box 52. Each hinge shaft 51 is movable between a hinge coupling position (the position of the hinge shaft 51 in FIG. 5B) where the hinge shaft 51 protrudes out of the hinge box 52 to be fitted into a hinge hole 55*a* which is formed in a hinge-shaft connection lug 55 of the upper casing 10, and a hinge releasing position (the position of the hinge shaft 51 of FIG. 5A) where the hinge shaft 51 is inserted into the hinge box 52 to be removed from the hinge hole 55*a*. Each first or second movable member 53 or 54 may be moved linearly by guiding a guide protrusion 51*a* of the hinge shaft 51 along a groove which is formed in the hinge box 52.

Further, the hinge connection unit 50 includes an elastic member 56 which is elastically provided between the first and second movable members 53 and 54, and a hinge-coupling retaining means which is manipulated on the outside of the hinge box 52 to move the hinge shaft 51 to the hinge coupling position and simultaneously retain the hinge shaft 51 in the hinge coupling position.

The elastic member 56 exerts an elastic force so that the hinge shaft 51 normally moves to the hinge releasing position. For example, both ends of a tension coil spring are supported by the first and second movable members 53 and 54.

The hinge-coupling retaining means may include a threaded hole 57 which is formed in the sidewall of the hinge box 52, and a hinge-coupling retaining member 58 having a threaded part 58*a* which is fastened to the threaded hole 57 in a threaded manner. A tapered part 58*b* is provided on an end of the threaded part 58*a* of the hinge-coupling retaining member 58, is inclined such that its tip is sharp, and is positioned between the first and second movable members 53 and 54. Preferably, a side surface of each of the first and second movable members 53 and 54 which are in contact with the tapered part 58*b* comprises an inclined surface that corresponds to the inclined surface of the tapered part 58*b*.

Preferably, the outer end of the hinge-coupling retaining member 58 is manipulated to be rotated on the outside of the hinge box 52. For example, a straight- or cross-shaped slot may be formed in the end of the hinge-coupling retaining member 58 to allow the hinge-coupling retaining member 58 to be rotated by a screwdriver, and a protrusion may be provided on the end to allow the hinge-coupling retaining member 58 to be rotated by hand without an additional tool.

Thus, as shown in FIGS. 5A and 5B, as the hinge-coupling retaining member 58 is rotated forwards and backwards on the outside of the hinge box 52, the hinge-coupling retaining member 58 moves forwards and backwards, thus actuating the first and second movable members 53 and 54. Thereby, each hinge shaft 51 may move between the hinge coupling position and the hinge releasing position.

Figure 6:
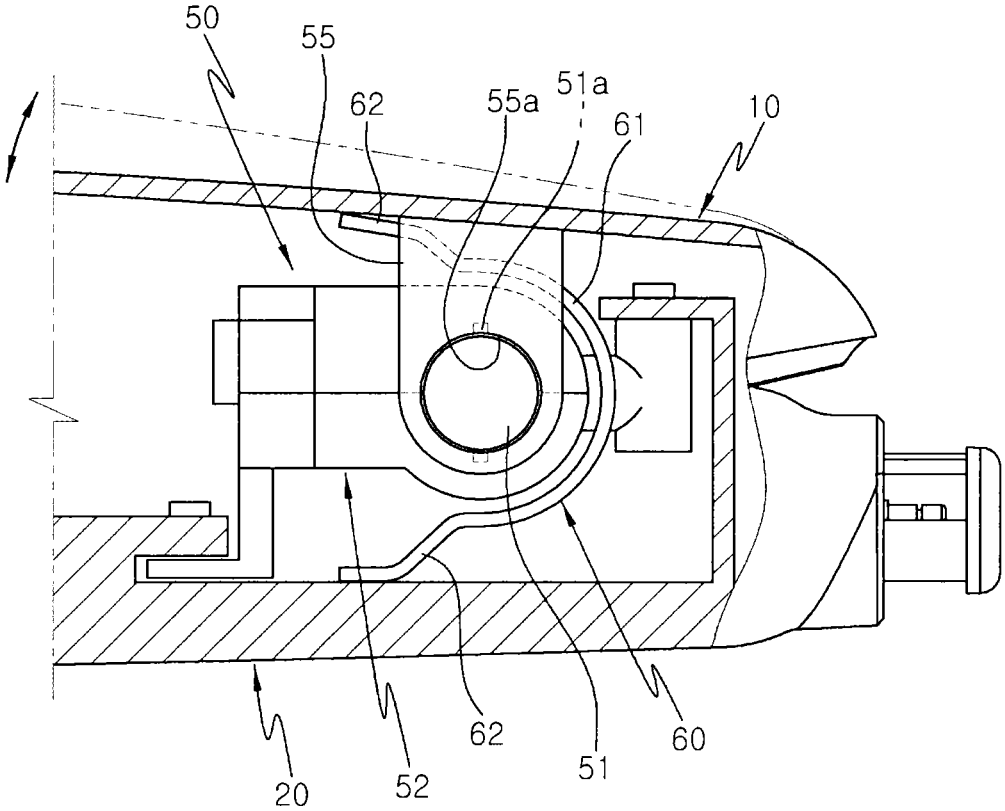
FIG. 6 is a sectional view showing the assembled hinge connection unit.

Subsequently, referring to FIGS. 3 and 6, the hair iron of the present invention includes a plate spring 60 which is elastically provided between the upper and lower casings 10 and 20 and exerts an elastic force in the direction in which the upper and lower casings 10 and 20 move when they move away from each other. Thus, the upper and lower casings 10 and 20 are normally open at a predetermined angle by the plate spring 60. When a force is applied to the upper and lower casings 10 and 20 so that they are closed as shown in FIG. 6, the plate spring 60 is compressed. In contrast, when the force is removed from the upper and lower casings 10 and 20, the upper and lower casings 10 and 20 open to their original positions under the elastic restoring force of the plate spring 60.

The plate spring 60 is constructed so that it is bent by a wide bent part 61 and narrow elastic contact parts 62 extend from the opposite ends of the bent part 61 as shown in FIG. 3, so that the plate spring 60 is supported by the inner surfaces of the upper and lower casings 10 and 20. Further, an elastic-force control hole 63 is formed in the wide bent part 61 to control the elastic force of the plate spring 60. As the size of the elastic-force control hole 63 is increased, the cross-sectional area of the bent part 61 is reduced, so that the elastic force is reduced. Meanwhile, as the size of the elastic-force control hole 63 is reduced, the cross-sectional area of the bent part 61 is increased, so that the elastic force is increased.

Turning back to FIG. 3, the hair iron of the present invention is provided with an insulating member 70 on a side opposite to a heat emission surface of each heat generating unit 30 or 40, that is, between each heat generating unit 30 or 40 and the upper or lower casing 10 or 20. The insulating member 70 functions to prevent heat from being transferred from each heat generating unit 30 or 40 to the upper or lower casing 10 or 20, thus reducing heat loss, and preventing the outer surface of the upper or lower casing 10 or 20, that is, a portion held by the hand from becoming hot.

Further, as shown in FIG. 3, a power supply circuit unit 11 or 21 is provided in the corresponding upper or lower casing 10 or 20 in such a way that the power supply circuit unit 11 or 21 and the heat generating unit 30 or 40 are arranged side by side, and functions to supply external power to the heat generating unit 30 or 40. The power supply circuit unit 11 or 21 is covered by an inner cover 12 or 22 which is coupled to the corresponding upper or lower casing 10 or 20 so as not to be exposed to the outside.

Figure 7:
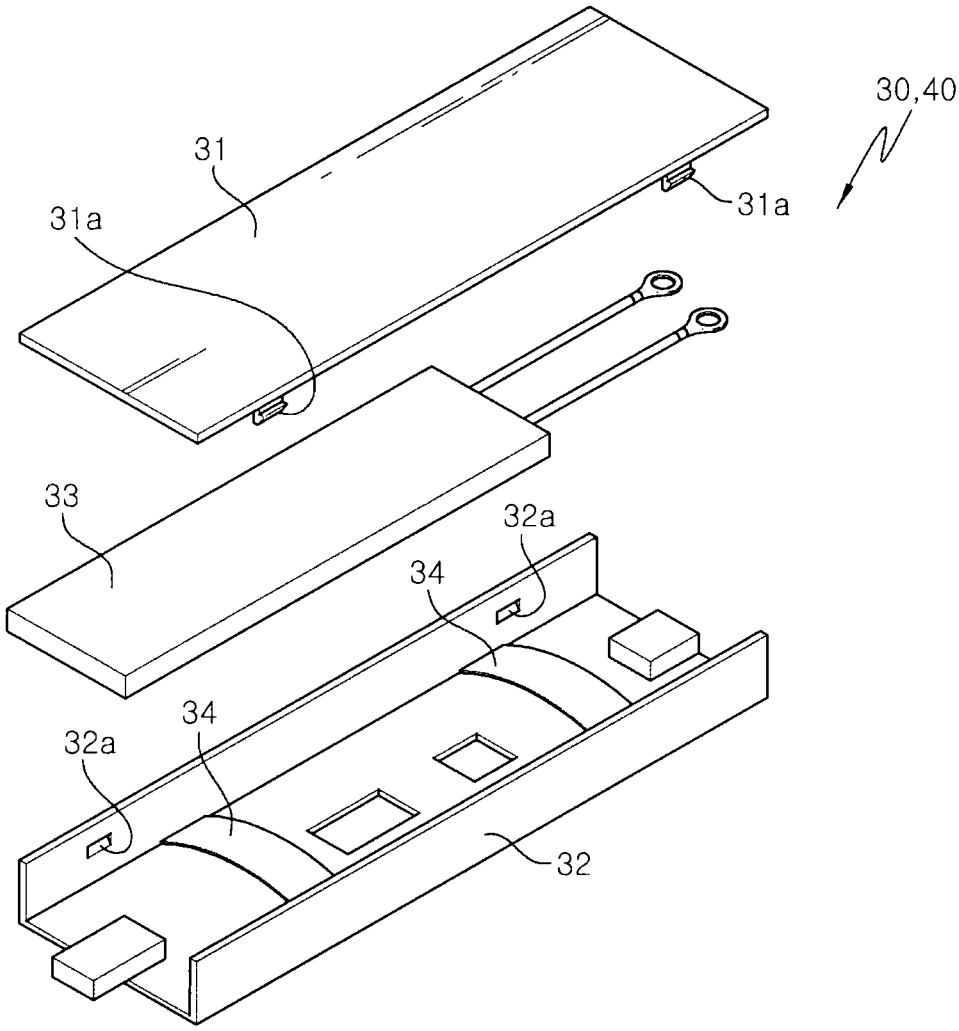
FIG. 7 is an exploded perspective view showing a heat generating unit of the hair iron according to the present invention.
Figure 8:
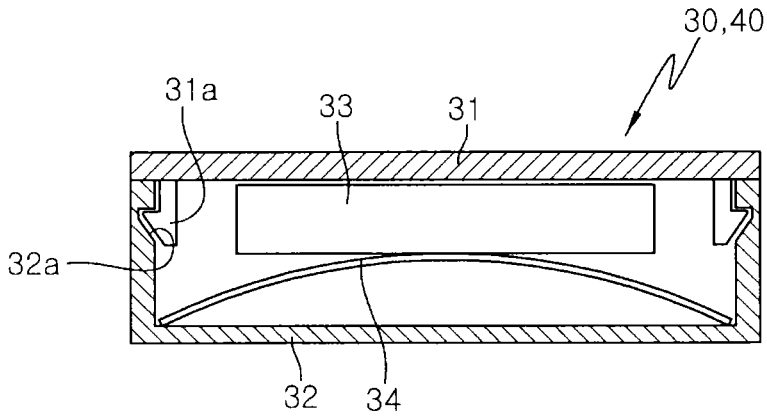
FIG. 8 is a vertical sectional view showing the heat generating unit.

Meanwhile, as shown in FIGS. 7 and 8, each heat generating unit 30 or 40 includes a hot plate 31 serving as the heat emission surface, a heater casing 32 coupled with the hot plate 31, and a heater 33 provided between the hot plate 31 and the heater casing 32 to heat the hot plate 31. The heater 33 generates heat by power transmitted from the power supply circuit unit 11 or 21 to the heater 33. A plurality of coupling protrusions 31*a* is provided on an edge of the hot plate 31, and a plurality of coupling holes 32*a* is provided on the inner surface of the heater casing 32 so that the coupling protrusions 31*a* are fitted into the coupling holes 32*a*, thus enabling the hot plate 31 and the heater casing 32 to be coupled with each other.

Further, contact members 34 are elastically provided between the heater 33 and the heater casing 32 to allow the heater 33 to be in close contact with the hot plate 31. Each contact member 34 comprises a plate spring which is curved at a central portion thereof. Thus, when the hot plate 31 is coupled with the heater casing 32, the curved portion of the plate spring 60 causes the heater 33 to elastically come into close contact with the hot plate 31.

Figure 9:
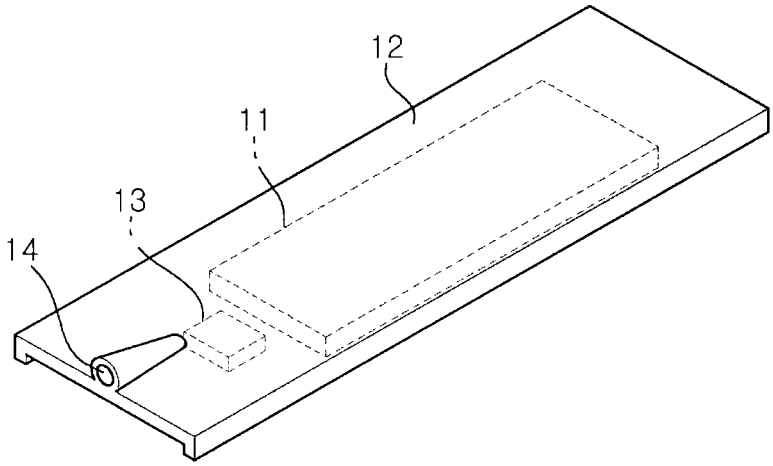
FIG. 9 is a perspective view showing an anion generating means of the hair iron according to the present invention.

Next, as shown in FIGS. 3 and 9, the hair iron of the present invention includes an anion generator 13 and an anion guide passage 14. The anion generator 13 is provided on either of the upper or lower casing 10 or 20, for example, the upper casing 10 to generate anions. The anion guide passage 14 functions to guide anions from the anion generator 13 to hair inserted between the upper and lower casings 10 and 20.

The anion generator 13 is known to those skilled in the art. Preferably, the anion generator 13 includes a charged plate which is made of a metal, such as copper or aluminum. When voltage is applied to the charged plate, anions are separated from the metal. To this end, the anion generator 13 is installed in the power supply circuit unit 11 so that the power supply circuit unit 11 applies voltage to the anion generator 13. An on/off switch 15 is located between the anion generator 13 and the power supply circuit unit 11 and connected by an electric wire (not shown), thus selectively operating the anion generator 13. It is preferable that the on/off switch 15 be exposed to the outer surface of the upper casing 10 for easy manipulation.

As shown in FIGS. 2 and 9, the anion guide passage 14 is formed through the inner cover 12, and is preferably inclined towards the heat generating unit 30 or 40 to guide anions from the anion generator 13 to the heat generating unit 30 or 40.

The hair iron of the present invention constructed as described above is operated as follows. First, in the hair iron of the present invention, the hinge connection unit 50 connecting the upper and lower casings 10 and 20 with each other can be easily assembled and disassembled, thus allowing the upper and lower casings 10 and 20 to be rapidly and conveniently assembled or disassembled. That is, when the hinge shafts 51 are in the hinge releasing position as shown in FIG. 5A, the hinge holes 55*a* formed in the hinge-shaft connection lugs 55 of the upper casing 10 are aligned with the hinge shafts 51, and thereafter, the hinge-coupling retaining member 58 is rotated, using a tool such as a screwdriver, on the outside of the hinge box 52 so that the hinge-coupling retaining member 58 moves forwards. At this time, the tapered part 58*b* of the hinge-coupling retaining member 58 positioned between the first and second movable members 53 and 54 moves the first and second movable members 53 and 54 in opposite directions. Thus, as shown in FIG. 5B, the hinge shafts 51 provided on both sides move to the hinge coupling position and are inserted into the hinge holes 55*a* formed in the hinge-shaft connection lugs 55 of the upper casing 10, so that the upper and lower casings 10 and 20 are easily hinged to each other.

At this time, the elastic member (tension coil spring) 56 elastically provided between the first and second movable members 53 and 54 is extended, so that elastic restoring force acts on the first and second movable members 53 and 54 so that they move to the hinge releasing position. However, since the threaded part 58*a* of the hinge-coupling retaining member 58 is coupled to the threaded hole 57 of the hinge box 52 in a threaded manner, the hinge coupled state may be maintained in the hinge coupling position as long as the hinge-coupling retaining member 58 does not rotate backwards. Even if the upper and lower casings 10 and 20 undergo repeated rotary motion about the hinge shafts 51, this does not affect the hinge-coupling retaining member 58 because the hinge shafts 51 move in the axial direction to perform hinge coupling, thus preventing the hinge coupling from being unexpectedly loosened.

In contrast, when a user desires to disassemble the upper and lower casings 10 and 20 that are hinged together, the hinge-coupling retaining member 58 rotates backwards to move backwards. At this time, as shown in FIG. 5A, the first and second movable members 53 and 54 are automatically restored to their original positions by the elastic restoring force of the elastic member 56, so that both the hinge shafts 51 move to the hinge releasing position where the hinge shafts 51 are removed from the hinge holes 55*a* formed in the hinge-shaft connection lugs 55 of the upper casing 10. In this way, the upper and lower casings 10 and 20 can be easily disassembled from each other.

Further, the hinge-coupling retaining member 58 for assembling and disassembling the hinge connection unit 50 is operated in the longitudinal direction of the upper and lower casings 10 and 20 inside the upper and lower casings 10 and 20. Since the hinge-coupling retaining member 58 is manipulated with the upper and lower casings 10 and 20 open, ends of both the hinge shafts 51 may be sufficiently covered by the lower casing 20. Thus, an additional cover member is not required, so that the number of parts can be reduced, and the appearance of the hinge connected part of the upper and lower casings 10 and 20 can be variously designed.

Further, the hair iron of the present invention controls the elastic force of the plate spring 60 by adjusting the size of the elastic-force control hole 63 formed in the bent part 61 of the plate spring 60 which is elastically provided between the upper and lower casings 10 and 20. The larger the elastic-force control hole 63 is, the smaller the cross-sectional area of the bent part 61 is, so that the elastic force of the plate spring 60 is reduced. The smaller the elastic-force control hole 63 is, the larger the cross-sectional area of the bent part 61 is, so that the elastic force of the plate spring 60 is increased. Thus, it is easy to control the elastic force of the plate spring 60, so that elasticity and the sensation when manipulating the hair iron can be optimized when it is being used.

Further, the hair iron of the present invention is provided with the insulating member 70 on the side opposite the heat emission surface of each heat generating unit 30 or 40, that is, between the upper or lower casing 10 or 20 and the corresponding heat generating unit 30 or 40. The insulating member 70 prevents heat from being emitted to the side opposite the hot plate 31 of each heat generating unit 30 or 40, thus preventing heat loss, therefore improving thermal efficiency. Further, the insulating member 70 prevents the outer surface of each upper or lower casing 10 or 20 held by the hand from becoming hot. The contact members 34 provided between the heater 33 and the heater casing 32 of each heat generating unit 30 or 40 allows the heater 33 to elastically come into close contact with the hot plate 31 when the hot plate 31 and the heater casing 32 are coupled with each other, thus improving heat transfer efficiency.

Further, in the hair iron of the present invention, when anions are generated by the anion generator 13, the generated anions are guided through the anion guide passage 14 to the hair fitted between the upper and lower casings 10 and 20, thus providing anions as nutrient to weakened hair and pore cells when the hair iron is in use, therefore serving to stimulate the pore cells and prevent hair loss. The anion generator 13 is turned on or off by manipulating the on/off switch 15 which is exposed to the outer surface of the upper casing 10, thus enabling a user to conveniently manipulate and selectively use the anion generator 13 when the hair iron is in use.

As described above, the present invention provides a hair iron, in which a hinge shaft is movable between a hinge coupling position and a hinge releasing position merely by simply manipulating the hinge shaft on the outside of a hinge box, thus allowing upper and lower casings to be very rapidly and conveniently hinged to and disassembled from each other, and the hinge shaft is moved in an axial direction different from the rotating direction, so that hinge coupling does not unexpectedly come loose, and the hinge box is covered with the casings, so that an additional cover member is not required.

Further, the present invention provides a hair iron, which can easily control an elastic force by adjusting the size of an elastic-force control hole formed in a bent part of a plate spring that is elastically provided between upper and lower casings, thus optimally improving elasticity and the sensation felt when manipulating and using the hair iron, and in which an insulating member provided on a side that is opposite to a heat emission surface of a heat generating unit prevents heat from being emitted to the opposite side of the heat emission surface, thus preventing heat loss, and in which a heater of the heat generating unit comes into close contact with a hot plate by a contact member, thus improving heat transfer efficiency.

Furthermore, the present invention provides a hair iron, which includes an anion generator to generate anions, thus providing anions as nutrient to weakened hair and pore cells when the hair iron is in use, therefore serving to stimulate the pore cells and prevent hair loss.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A hair iron having upper and lower casings separated from each other to allow hair to be fitted between the upper and lower casings; a heat generating unit provided on either or both of the upper and lower casings; and a hinge connection unit connecting first ends of the upper and lower casings with each other via a hinge shaft so that the upper and lower casings rotate at a predetermined angle about the hinge shaft, wherein the hinge connection unit comprises:

a hinge box secured to either of the upper and lower casings;

first and second movable members provided in the hinge box, and moving between a hinge coupling position where the hinge shaft protrudes out of the hinge box and a hinge releasing position where the hinge shaft is inserted into the hinge box, each of the first and second movable members having the hinge shaft;

an elastic member elastically provided between the first and second movable members, and exerting an elastic force so that the hinge shaft moves to the hinge releasing position;

hinge-coupling retaining means manipulated on an outside of the hinge box to move the hinge shaft to the hinge coupling position and simultaneously retain the hinge shaft in the hinge coupling position; and a hinge-shaft connection lug provided on a remaining one of the upper and lower casings, and having a hinge hole into which the hinge shaft is fitted when the hinge shaft is in the hinge coupling position.

2. The hair iron as set forth in claim 1, wherein the hinge-coupling retaining means comprises:

a threaded hole formed in a sidewall of the hinge box; and a hinge-coupling retaining member manipulated to be rotated on the outside of the hinge box, and comprising:

a threaded part fastened to the threaded hole in a threaded manner; and a tapered part provided on an end of the threaded part in such a way that a tip of the tapered part is inclined to be sharp, and disposed between the first and second movable members.

3. The hair iron as set forth in claim 1, further comprising:

a plate spring elastically provided between the upper and lower casings, and exerting an elastic force in a direction in which the upper and lower casings move when the upper and lower casings move away from each other, wherein the plate spring comprises a wide bent part, and a narrow elastic contact part which extends from each of opposite ends of the bent part, with an elastic-force control hole being formed in the wide bent part.

4. The hair iron as set forth in claim 1, wherein an insulating member is provided on a side opposite to a heat emission surface of the heat generating unit.

5. The hair iron as set forth in claim 4, wherein the heat generating unit comprises:

a hot plate serving as the heat emission surface;

a heater casing coupled with the hot plate;

a heater provided between the hot plate and the heater casing and heating the hot plate; and a contact member elastically provided between the heater and the heater casing, and making the heater come into close contact with the hot plate.

6. The hair iron as set forth in claim 1, wherein either of the upper and lower casings comprises:

an anion generator generating anions; and an anion guide passage guiding the anions from the anion generator to the hair fitted between the upper and lower casings.

7. The hair iron as set forth in claim 3, wherein an insulating member is provided on a side opposite to a heat emission surface of the heat generating unit.

8. The hair iron as set forth in claim 7, wherein the heat generating unit comprises:

a hot plate serving as the heat emission surface;

a heater casing coupled with the hot plate;

a heater provided between the hot plate and the heater casing and heating the hot plate; and a contact member elastically provided between the heater and the heater casing, and making the heater come into close contact with the hot plate.

9. The hair iron as set forth in claim 3, wherein either of the upper and lower casings comprises:

an anion generator generating anions; and an anion guide passage guiding the anions from the anion generator to the hair fitted between the upper and lower casings.

* * * * *